US006620444B1

(12) United States Patent
Reichinger

(10) Patent No.: US 6,620,444 B1
(45) Date of Patent: Sep. 16, 2003

(54) TWO-COMPARTMENT CONTAINER FOR AND METHOD OF ADMIXING A FLAVOUR TO A BEVERAGE

(75) Inventor: Richard Reichinger, Liverpool (GB)

(73) Assignee: Schmalbach-Lubeca AG, Ratingen (DE)

( * ) Notice: Subject to any disclaimer, the term of this patent is extended or adjusted under 35 U.S.C. 154(b) by 0 days.

(21) Appl. No.: 09/674,019

(22) PCT Filed: Apr. 16, 1999

(86) PCT No.: PCT/EP99/02592

§ 371 (c)(1),
(2), (4) Date: Jan. 30, 2001

(87) PCT Pub. No.: WO99/54229

PCT Pub. Date: Oct. 28, 1999

(30) Foreign Application Priority Data

Apr. 22, 1998 (EP) ..... 98107357

(51) Int. Cl.[7] ..... B65D 25/08

(52) U.S. Cl. ..... 426/115; 426/120; 426/394; 426/519; 206/220

(58) Field of Search ..... 426/112, 115, 426/116, 118, 119, 120, 131, 394, 395, 519; 206/0.5, 220, 222; 99/323.1

(56) References Cited

U.S. PATENT DOCUMENTS 2,753,990 A * 7/1956 Chalfin et al. ..... 206/47
4,627,986 A * 12/1986 Bardsley et al. ..... 426/112
4,832,968 A * 5/1989 Forage et al. ..... 426/112
5,474,788 A * 12/1995 Lynch ..... 426/112
5,620,725 A * 4/1997 Jamieson et al. ..... 426/112
6,250,346 B1 * 6/2001 Castillo ..... 141/100

FOREIGN PATENT DOCUMENTS

| | | | |
|---|---|---|---|
| EP | 965536 A1 | * | 12/1999 |
| JP | 2000335652 A | * | 12/2000 |
| WO | WO 91/07326 | | 5/1991 |
| WO | WO 93/24384 | * | 12/1993 |
| WO | WO 95/04689 | | 2/1995 |
| WO | WO 95/32130 | * | 11/1995 |
| WO | WO 96/24542 | * | 8/1996 |

* cited by examiner

*Primary Examiner*—Drew Becker
(74) *Attorney, Agent, or Firm*—Heller Ehrman White and McAuliffe

(57) ABSTRACT

The present invention is directed to a two-compartment container for receiving a flavour for the mixture thereof with a main beverage liquid in a beverage container immediately after opening the beverage container, one compartment of which comprises a small orifice for merely slow equilibration of pressure between the inside thereof and the outside of the two-compartment container, characterized in that the two compartments are separated by an interior wall which does not allow exchange of gas or liquid between the two compartments. It is intended that one of the compartments is completely filled with the flavour, e.g. a liquid or a granulate, while the other one mainly or merely contains gas.

18 Claims, 3 Drawing Sheets

TWO-COMPARTMENT CONTAINER FOR AND METHOD OF ADMIXING A FLAVOUR TO A BEVERAGE

The present invention is directed to a twin-compartment container or two-compartment container for use in a beverage container whereby two products will remain separate until the moment that the customer wishes to consume the mixture thereof. This ensures that the mixture is fresh and in the ideal condition to drink.

BACKGROUND OF THE INVENTION

It is a well-known technique to use small capsules or the like for initiating a production of bubbles in a beverage which contains carbon dioxide and optionally nitrogen. Specifically, such capsules are intended to provide a creamy head on freshly poured out beer. Bubbles may be initiated as follows: During the filling process of the beverage container, a drop of liquid nitrogen or the like is deposited in the container before it is rapidly closed. The liquid nitrogen evaporates and, together with the carbon dioxide present, an over-pressure is created in the container, e.g. by the said nitrogen. The capsule inside the container which is fixed to the bottom of the container or close thereto, has at least one opening which is very small. Immediately upon closure of the container, the latter is placed upside down such that the small opening of the capsule comes into communication with the headspace above the beverage in the container. Now, pressure equilibration between the inside of the capsule and the headspace above the beverage occurs. The gas under pressure enters the capsule until the inside pressure and the outside pressure are equal. Subsequently, the container is brought into its "normal" upright position. Due to the surface tension of the beverage, no or only few liquid may enter the capsule. Upon opening the beverage container, the pressure within the container drops immediately to ambient pressure thereby inducing a pressure difference between the inside and the outside of the capsule. This causes release of small bubbles through the small opening(s) which assist in the formation of the desired head of the beverage.

Instead of small orifices, the capsule may be provided with different valve means which respond to the mentioned pressure difference upon opening the beverage container. In such cases, positioning of the container into "upside down" is not required; however, production costs are increased. Moreover, these capsules are to be filled with gas and closed under over-pressure.

In WO 91/07326, such a capsule is disclosed. It is in the form of a closed hollow insert (for insertion into a container) having means responsive to opening of the container to provide communication between the inside of the insert and beverage contained in the body of the container upon opening of the container. The orifice in the wall of the capsule is in the lower half of the capsule and is suitably in a lower wall, suitably at or burst disk which, upon subjecting the burst disk to the pressure difference between the inside of the capsule and the atmosphere pressure in the container as or after it is opened, bursts to provide the orifice. The closure means may alternatively comprise a manually openable valve or puncturing device connected to the container closure. Alternatively, the closure means may comprise a pressure responsive valve which, when exposed to the pressure difference between the inside of the capsule and the atmospheric pressure in the container after opening, opens. The valve may suitably consist of a bore terminating in an orifice and a clock on the outside of the capsule which fits inside the b ore and which, when subjected to the pressure difference created on opening the container, is blown out of the bore. Additional embodiments of the valve are also described.

Recently, it has been suggested in PCT/EP 94/02491 to use such known insert as a capsule for receiving a second liquid to be mixed with the beverage liquid immediately before the beverage in the container is poured out or consumed. It is suggested to partly fill the said capsule with the second liquid whereby a second headspace above this liquid is provided. When the beverage container is opened and the pressure in the primary headspace above the beverage liquid in the beverage container drops to atmospheric, the pressure difference between the secondary headspace and atmospheric pressure causes the pressure-sensitive closure to open an orifice in the wall of the capsule, the orifice in the wall of the capsule being in the lower half of the capsule, and the secondary liquid to be ejected from the capsule into the primary liquid.

The said capsule is preferably precharged to a pressure above atmospheric. When this is the case, it may be held under this pressure whilst it is inserted into the container and the entire container and capsule held under this pressure whilst it is filled with a primary liquid. Due to the presence of a valve resisting to the step of pre-pressurizing the interior of the capsule, costs to provide such a capsule are very high.

It is also possible according to the said application to not pre-pressurize the capsule. In this case, there must be communication between the interior of the capsule and the outside thereof inside the beverage container which may cause contamination (e.g. leakage of the second liquid), or there must be a need for physical changes in the capsule to take place, e.g. shrinking, softening or the like. It is obvious that such additional steps and selection of useful materials therefore is also a source for additional costs.

However, because beverage containers are produced in high numbers, it is desired to lower the costs for such capsules.

SUMMARY OF THE INVENTION

Accordingly, the present invention provides a container for receiving a flavour for the mixture thereof with a first beverage liquid in a beverage container immediately after opening the beverage container. It is a two-compartment container which does not need to be pre-pressurized before its insertion into the beverage container. One of the two compartments ("first compartment") is intended to be completely filled with the flavour, while the other one ("second compartment") is intended to be filled only with gas. The flavour may be a second beverage liquid, a syrup, or may be in a solid state, e.g. a powder or granulate. That compartment which contains gas (second compartment) is in communication with the outside, i.e. the so called primary chamber of the beverage container. This communication is provided by at least one orifice being of any shape provided that the gas flow is restricted sufficiently so that, on one hand, a gas flow slowly equilibrates the pressure difference inside and outside the compartment after closure of the beverage container within a considerable period of time, e.g. in the range of from some seconds to half an hour or one hour, while, on the other hand, upon a sudden pressure decrease in the primary chamber of the beverage container (i.e. after opening it), the gas cannot escape sufficiently fast to equilibrate the pressure decrease in the same magnitude of time as it appears on opening the beverage container (i.e. in the range of about 1/100 to 1/10 of a second).

There is no communication between the flavour containing, first compartment of the two-compartment container and the primary chamber of the beverage container. This first compartment is completely sealed. Preferably, it is completely filled with the second liquid, powder, granulate or the like.

In one embodiment of the invention, the two-compartment container of the present invention consists of at least two parts, a top part and a base part, at least one of which having side walls extending to the other part, such that upon connecting both parts, the said two compartments are provided. Two different kinds of side walls exist.

The surrounding outer side wall of the two-compartment container at least partly defines the outer wall of the gas containing compartment (second compartment) and is connectable or connected to the opposite base part or top part via closure means. This closure means must be such that it opens or breaks upon the sudden pressure difference which appears as soon as the seal of the beverage container is opened and the container is vented, whereby the overpressure decreases to ambient pressure. The orifice(s) in the gas containing compartment provided for slow equilibration of pressure is/are restricted such that during the sudden pressure decrease, the gas is not able to exit this orifice(s) in order to equilibrate the pressure. Therefore, the pressure difference upon opening the beverage container fully rests on the said closure means. Because it cannot withstand the force caused by the pressure difference, the closure means opens or breaks.

The inner side wall which separates the two different compartments inside the two-compartment container is a continuous wall which fits tightly to the opposite part (base part or top part), as long as both parts of the two-compartment container are connected. Due to this, the two compartments are completely separated without the possibility that gas or other fluid escapes from its compartment and introduces into the other compartment. However, there is no closure means or only a rather weak one between the said inner side wall and the respective opposite part of the two-compartment container so that upon opening or rupture of the connection between the outer side wall and the opposite base part or top part, the inner side wall does no longer tightly fit to the opposite part of the said container but is released therefrom. Consequently, the flavour can freely escape from its compartment.

The at least one small orifice for merely slow equilibration of pressure between the inside of the gas containing compartment of the two-compartment container and the outside thereof may be one upper restricted orifice provided in an upper part of the outer wall or in the top thereof. This restricted orifice is of such a size that, being in communication with the liquid in the container, no or only few liquid may enter. This is due to the "bubble point effect" caused by surface tension forces. However, the restricted orifice allows slow equilibration of pressure between the inside and outside, as detailed above. "Slow equilibration" means equilibration during a time period of from about a few seconds up to half an hour or one hour: It is assumed that a drop of liquid nitrogen added immediately before the beverage container is sealed will evaporate during about 15 seconds. As an example, it may take about the same time to equilibrate about 80% of the pressure difference if the restricted orifice is in communication with the gaseous headspace of the beverage container (e.g. in upside down position of the beverage container if the two-compartment container is sealed to the bottom thereof. Full equilibration will normally almost or fully be completed after the—optional—pasteurization has been finished (e.g. within 0.5–1 hour).

The restricted orifice may be a small hole extending through the wall or top of the respective part of the two-compartment container. Alternatively, it may consist e.g. of the following elements: around the orifice, the top part surface is restricted forming an almost cylindrical recess from whose base the frusto-conically tapered portion extends upwards towards or reaching height of the top part surface. The restricted orifice is provided at the top of the said frustoconically tapered part. In still another exemplary embodiment, the inside of the top part is provided with a small cylindrical body made of the same material. Extending through this cylinder and through the top part, a small hole extends providing the orifice at the surface of the top part.

The closure means of the surrounding outer wall may e.g. be a snap-fit connection, an interference fit connection or a membrane. The snap-fit must be tightly fitting; however, it must be sufficiently weak that the forces to be overcome when the snap-fit is opened (i.e. friction forces and shape changing forces) are less than the forces caused by the pressure difference upon opening the beverage container. Ideally, the two-compartment container is made from a material which is sufficiently flexible to provide small shape changing forces, e.g. a polyalkylene, preferably polypropylene. This material may advantageously be used for preparation of the complete two-compartment container because it is hydrophobic, providing the desired surface tension characteristics. In a specific embodiment, the surface of those parts of the two-compartment container providing the snap-fit are coated with a friction-reducing agent or lubricant. If the closure means is an interference fit, the base part of the two-compartment container comprises a lower part of the outer side wall (i.e. integrally or inseparably mounted or connected), and the top part thereof likely comprises an upper part of the outer side wall. The fit is provided by overlapping upper and lower side wall parts. The forces to open the interference fit between both side wall parts must be sufficiently weak and less than the forces caused by the aforementioned pressure difference upon opening the beverage container. The seal of the interference fit may either be provided only by the area of overlapping walls or additionally by a gasket or packing ring. In another embodiment, the closure means is a thin membrane. This membrane may e.g. constitute the top part or the base part of the two-compartment container which may be weakly sealed to the respective outer wall ends. It must be sufficiently strong such that in case the seal to the outer wall ends bursts or breaks due to the sudden pressure difference, the fitting with the inner wall is also opened.

The inner wall which tightly fits to the opposite part of the two-compartment container may be without any closure means. Upon opening the connection between the outer side wall and the opposite part, liquid or powder or the like can therefore freely escape from its compartment. In another embodiment of the invention, closure means are provided in order to form the tight fitting. However, these closure means must be weak and must open together with the disconnection of the closure means of the outer side wall. For example, it may be an interference fit the overlapping distance of which is lower than that of an interference fit between parts of the surrounding outer wall. If the forces of the pressure difference upon opening the beverage container urge the interference fit between the outer wall parts to open, the lower length of interference of the inner wall necessarily provides opening thereof.

In a preferred embodiment, the two-compartment container consists of the top part comprising the top, the inner wall and the surrounding outer wall. The lower ends of the walls fit with the base part, and the surrounding outer wall thereof comprises means for a snap-fit, as well as the bottom part of the two-compartment container. In order to fill such a container, it is brought in an upside down position.

In a further preferred embodiment, the two-compartment container has a substantially cylindrical form, the bottom having the shape of a circular plate (or dome) extending outwardly therefrom. The outer wall and the bottom (or, in another embodiment, the top) are provided with closure means, and the closure extends roundabout the bottom of the two-compartment container. The first compartment of the two-compartment container which is intended to be filled with a flavour may be inside the second compartment. In this case, an inner wall (which may consist of four walls arranged in a rectangular form or the like, however, has preferably a circular shape) is provided. Thus, the inner wall separating a first and a second compartment does not extend to the outer wall so that the second compartment intended to receive the gas completely surrounds the first compartment. This latter embodiment is preferred, and specifically, an embodiment comprising circular inner and outer walls is preferred. Such containers may be advantageously prepared with low costs. There is no need that the outer or second compartment has the same height as the inner compartment. It may be favorable that it is lower. In this case, the tops of the two compartments are separated by a step or shoulder.

The invention shall now be described with reference to the figures for additional illustration only.

DETAILED DESCRIPTION OF THE DRAWINGS

Figure 1A:
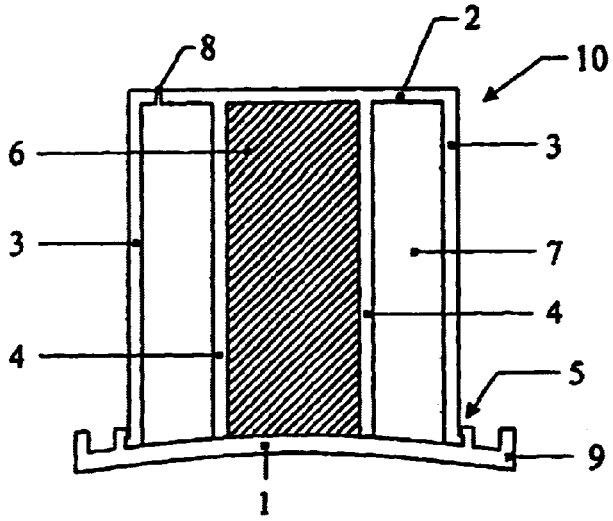
FIG. 1*a* depicts a two-compartment container of the present invention comprising a snap fit as closure means of the outer wall, in a sectional part view
Figure 1B:
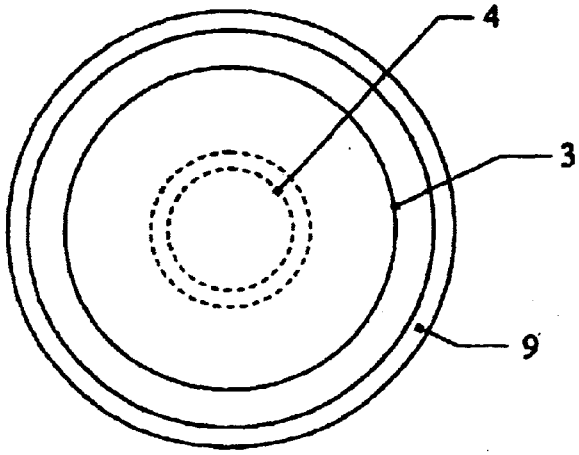
FIG. 1*b* is a schematic view showing the arrangement of the walls and the closure means.

In FIG. 1*a*, a base part 1 of a two-compartment container is seen which is connected to the top part 10 thereof which has a top 2, outer walls 3 and inner walls 4. Closure means 5 are provided in the form of a snap-fit. The base part is slightly domed in order to fit to the bottom of the respective beverage container. Walls 4 separate an inner first compartment 6 to be filled with the flavour. The dark bars shall represent the said flavour. The second or outer compartment 7 surrounding the first or inner compartment is intended to be filled with gas. That part of the top which constitutes the top of the outer, second compartment comprises a restricted orifice 8 through which pressure equilibration between inside and outside may occur. 9 depicts a folded edge, a feature not necessary for performing the present invention. In FIG. 1*b*, the circular shape of the inner wall 4 and the outer wall 3 is depicted. Please note that outer wall 3 is only indicated as a circular line.

Figure 2:
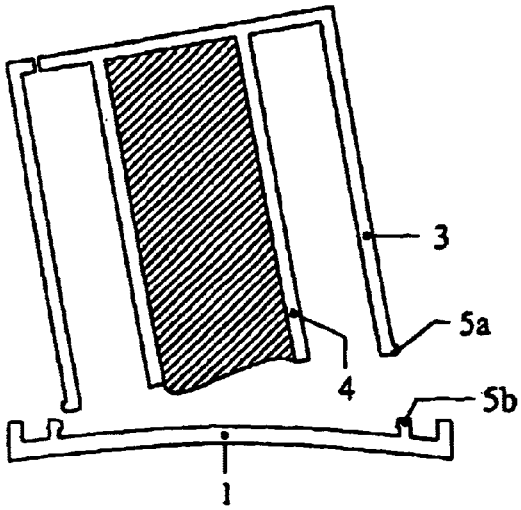
FIG. 2 shows the same container after the closure thereof has opened or is broken.

FIG. 2 shows the same two-compartment container after a rapid pressure decrease in the beverage container has taken place due to opening the seal thereof. The closure means in form of the snap-fit between the end of wall 3 (5*a*) and respective parts provided on the base part 1 of the two-compartment container (5*b*) have been opened. Because there is no seal or closure between the inner wall 4 and the base part 1, flavour may freely escape into the beverage environment.

Figure 3A:
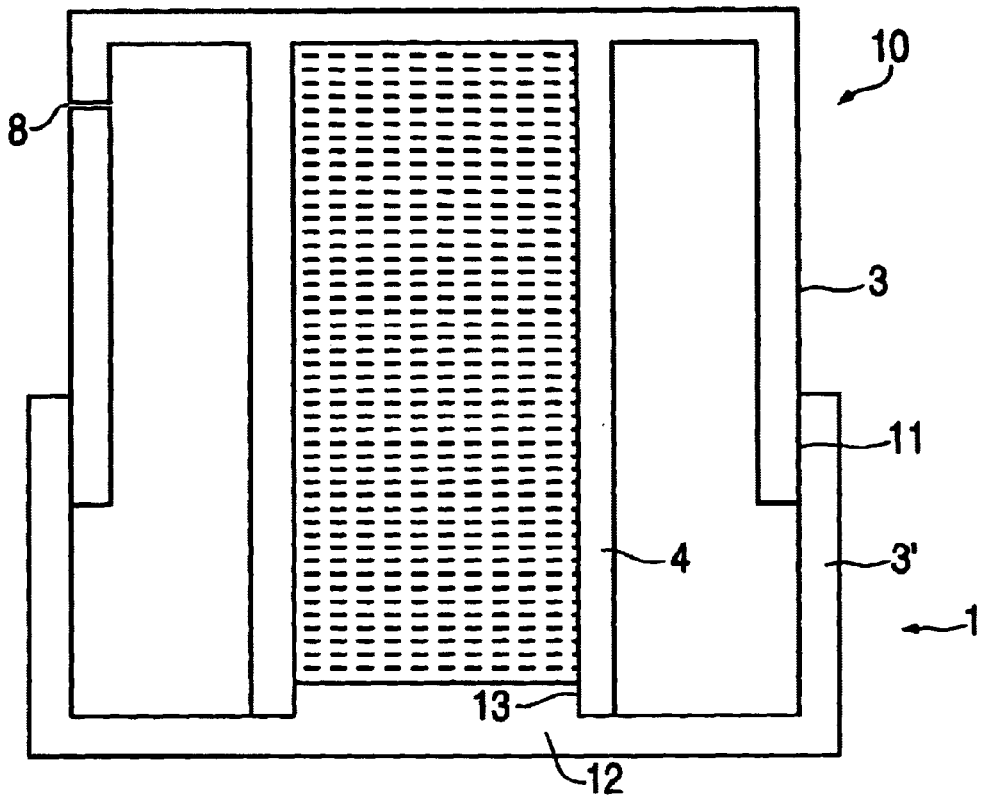
FIGS. 3*a* and 3*b* depict another embodiment of the two-compartment container of the present invention wherein the closure means of the surrounding outer side wall is an interference fit and the inner side wall fits tightly to the bottom of the compartment also via an interference fit which, however, has a smaller overlapping range compared to that of the outer wall. Also, these figures are cross sections.

FIG. 3*a* shows a two-compartment container made of two parts of plastics, preferably polypropylene. The top part 10 consists of a top 2 integrally connected to the inner side wall 4 and the upper part of the outer side wall 3. The base part 1 consists of a bottom 12 having an increased diameter of thickness in the area of the inner (first) compartment and providing a respective step 13, and lower outer side walls 3'. The ends of the surrounding outer side wall parts 3 and 3' overlap at 11 providing an interference fit. Friction forces are the only forces which keep the interference in the overlapping range. The inner side wall 4 overlaps the step 13 of the base part so that the inner side wall is tightly fitted to bottom 12 providing an interference fit having about ⅓ the length of that of the outer wall parts. Therefore, if the interference fit between the outer wall parts 3, 3' is opened, the flavour inside the inner compartment may freely escape. In an upper part of the outer wall 3, a restrictive orifice 8 is to be seen.

Figure 3B:
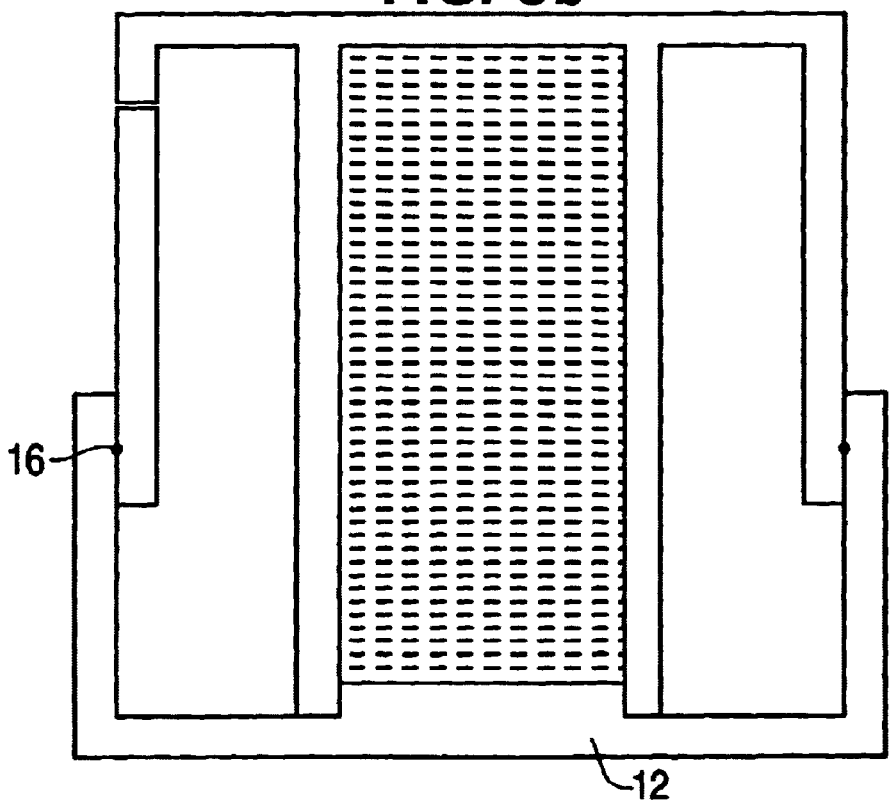

FIG. 3*b* differs from FIG. 3*a* in that an additional O-ring 16 is provided inside the interference fit. This ring may e.g. be prepared from rubber or Teflon.

Figure 4A:
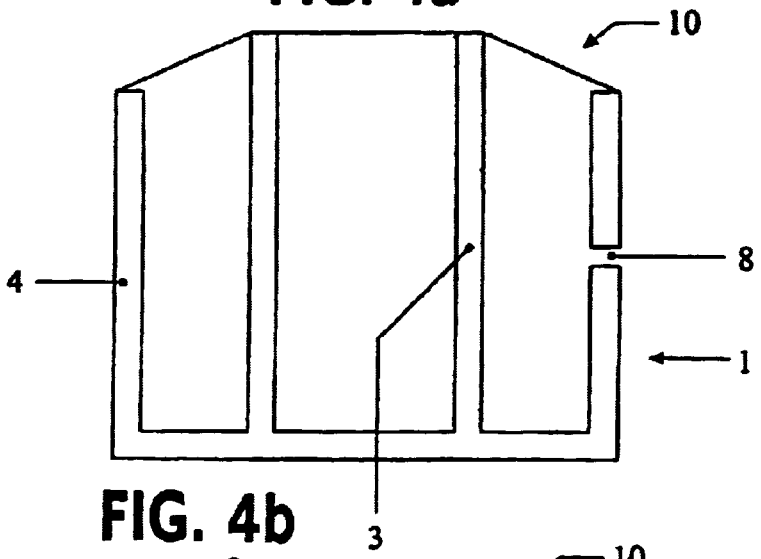
FIGS. 4*a* and 4*b*, also being cross sections, depict still different embodiments of the two-compartment container wherein the top part consists of a membrane.

FIG. 4*a* depicts an embodiment of the invention in which the top part 10 of the two-compartment container consists of a membrane which is sealed to the upper end of inner side wall 3 and outer side wall 4 so that the top 2 has a frustoconically tapered form. Due to this form, the membrane tightly fits to the ends of inner wall 3 without any additional seal. The membrane is sealed to the outer side wall 4, e.g. via a gasket. The membrane may be a flexible or a hard membrane.

Figure 4B:
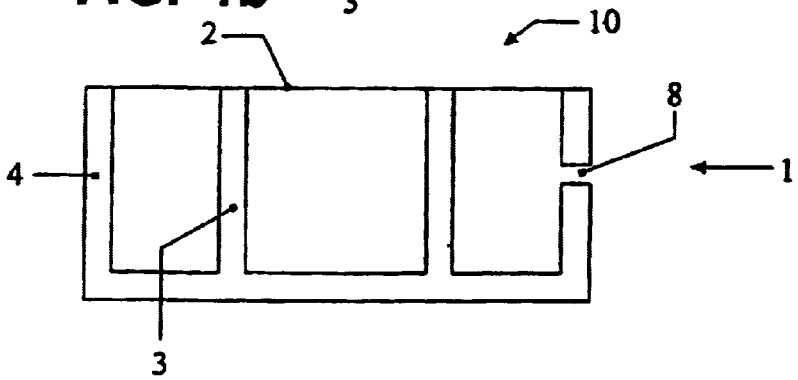

FIG. 4*b* shows another two-compartment container having a membrane in which the length of side walls 3 and 4 is equal. The membrane should be sufficiently stiff so that rupture of the seal 14 provides also opening of the inner compartment 6. Preferably, the membrane is sealed to both wall ends 3 and 4.

Figure 5:
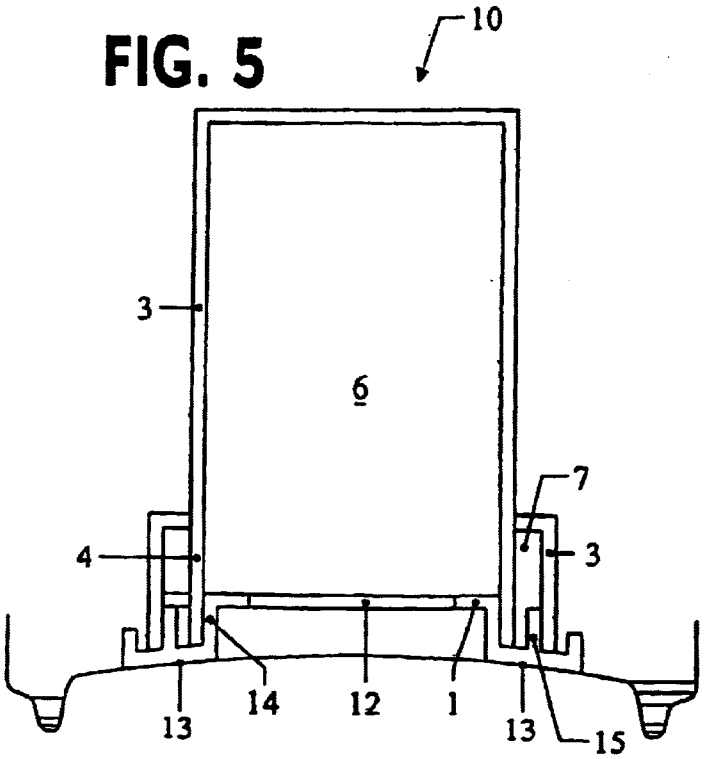
FIG. 5 shows still another embodiment of a two-compartment container wherein inner and outer compartment are of different height.

FIG. 5, like FIG. 1, shows a two-compartment container consisting of a base part 1 and a top part 10. The inner or first compartment 6 is enlarged, the second or outer compartment 7 is reduced, as compared to the container of FIG. 1. The side wall of the inner compartment is partly the inner side wall 4 separating the two compartments, and partly an outer side wall 3 (in its upper part). The base part 1 has a recessed middle part, the connection of the bottom 12 to the bottom of the beverage container 13 being provided by its outer parts 13. Step 14 provided by the recess is sealed to inner side wall 4 giving an interference fit. An outer interference fit 15 consists of the lower end of outer wall 3 and a respective structure on bottom 12. The length of interference of fit 15 is increased as compared to that of the fit at 14.

Any flavour may be filled into the inner compartment of the two-compartment container which is intended to be mixed with the outer or main liquid immediately before the beverage is consumed. The main beverage may be beer, water with or without carbon dioxide, optionally carbonated juice or the like. In a preferred embodiment, the main beverage is beer, e.g. German "Weissbier", and the flavour may be a flavoured sirup, e.g. sirup flavoured with woodruff or raspberry. In such a case, the two-compartment container is designed such that the common amount of this flavour may be contained. However, the present invention is also useful for mixing e.g. concentrated fruit juice or another, optionally strongly coloured, flavoured sirup into water. This may advantageous in cases where diluted sirup of fruit juice is not stable. Moreover, in case a transparent beverage container is used, mixture of both liquids may be observed by the consumer and, as well, assessed for stable separation of the two beverage liquids. The completeness of mixing will depend on the viscosity of both liquids. However, it may be advantageous to not provide complete mixing. E.g. in aforesaid combination of "Weissbier" and flavour, the obtained beverage is called "Berliner Weisse" which is characterized in that parts of the beverage should taste almost like beer alone, while other parts are strongly sweetened by the woodruff or raspberry flavour. In other embodiments, the first compartment is filled with a flavouring powder or granulate or the like.

Method of operation of the present invention is as follows:

The two-compartment container is normally produced in two parts, the top part and the base part. In some instances, only one of these parts has the inner and outer walls (i.e. the walls are integrally or inseparately connected or mounted thereto). Instead, it is possible that one of the said parts has the outer wall, and the other one has the inner wall. Generally, as specifically described above for the interference fit, the top part may have the upper part of either or both of inner and/or outer side walls, and the base part may have the complementary lower wall parts. The respectively suitable part is filled with the flavour, followed by connecting both parts via the closure means. This may be done in a nitrogen or other protecting gas atmosphere, thus providing the second or outer compartment filled with the said gas. Subsequently, the two-compartment container may be placed into the beverage container. It may be brought into it before the container is filled with the first beverage liquid and may be glued or otherwise adhered at the inside e.g. of the bottom of the said container. Adherence may be performed using respective structures in the bottom of the beverage container and the base part of the two-compartment container, e.g. a snap-fit or the like. Subsequently, the container is filled with the beverage. In an alternative embodiment, the beverage container is filled with the beverage liquid first, and afterwards the two-compartment container will be introduced. In this case, it will freely float or move in the beverage, and, depending e.g. on its specific weight, sink or swim.

Afterwards, the beverage container is closed. This may be performed in a known manner, e.g. seaming a double seam after providing a drop of liquid nitrogen or another means for increasing the pressure inside the beverage container. After seaming, the second or outer compartment of the two-compartment container should be brought into contact with the gaseous headspace of the beverage container e.g. by bringing the beverage container in an upside down position if the two-compartment container is fixed to the bottom thereof. Consequently, gas from the head space will migrate into the said second or outer compartment of the two-compartment container. The gas will be introduced through the restricted orifice. Equilibration of pressure inside and outside will be slow as described above, due to the restricted orifice. However, liquid is at least mostly prohibited to be introduced due to the surface tension and the shape of the orifice. After equilibration of the pressure, the pressure inside the outer compartment of the two-compartment container will be above ambient pressure. In such a way, the container is "primed". This is similar to the charging of the gas container for inducing a head of bubbles in a beer container. Due to the fact that the inner wall fits tightly to the opposite base part or top part, the inner and the outer compartment are completely separated without exchange of liquid or gas, thus keeping the flavouring separate from the product within the container.

On opening, the beverage container will immediately vent and the pressure within the container will suddenly drop to ambient pressure. However, the pressure within the two-compartment container will still remain at or near that of the container prior to opening as the gas struggles to escape through the restricted orifice. This pressure will generate sufficient force to break or open the mechanical closure, e.g. snap-fit, interference fit or membrane-wall-connection. Upon opening, bursting or breaking, the two parts of the container are separated. Because there is no or only weak closure between the inner side wall and the opposite top or base part, flavouring may freely escape from the respective compartment and will enter the first liquid beverage.

As both the container base and top, either of them comprising the walls, should be larger than the end aperture of the beverage container, it is not possible for any part of the container to be swallowed by the consumer.

In case the two-compartment container is fixed to the base or a side wall of the container, the top part thereof becomes loose upon break or opening of the closure in response to opening the seal of the beverage container. This could be used as an audible signal for the consumer that the mixing was successful.

What is claimed is:

1. Two-compartment container, comprising a surrounding outer side wall, an inner side wall that separates the two compartments, a base part and a top part, wherein at least one of said base part or top part has such side walls which extend such that (a) upon connecting the top part to the base part, a first compartment defined by the inner part of the base, the inner side wall which is a surrounding inner side wall and the inner part of the top and a second compartment defined by an outer part of the base, the inner side wall, the outer side wall and an outer part of the top are provided; wherein the top and/or outer side wall of the second compartment comprises at least one small orifice for slow equilibration of pressure between the inside thereof and the outside of the two-compartment container; wherein the outer side wall is connected to the base part or top part via closure means, and the inner side wall tightly fits to the base part or top part; wherein gas or liquid cannot be exchanged between the first and second compartments; and wherein upon a sudden pressure difference between the outside of the two-compartment container and the inside of the second compartment, the said closure means of the outer side wall will open or break and the inner side wall will no longer tightly fit to said base part or top part, or (b) the two-compartment container has a substantially cylindrical form, wherein the surrounding outer side wall is circular while the inner side wall extends straight-lined and divides the interior into a first and second compartment each having the shape of a half circle as a basis; wherein the top and/or outer side wall of the second compartment comprises at least one small orifice for slow equilibration of pressure between the inside thereof and the outside of the two-compartment container; wherein the outer side wall is connected to the base part or top part via closure means, and the inner side wall tightly fits to the base part or top part; wherein gas or liquid cannot be exchanged between the first and second compartments; and wherein upon a sudden pressure difference between the outside of the two-compartment container and the inside of the second compartment, the said closure means of the outer side wall will open or break and the inner side wall will no longer tightly fit to said base part or top part.

2. Two-compartment container of claim 1, wherein the top part has the side walls.

3. Two-compartment container of claim 1, wherein the closure means comprise a snap fit, an interference fit or a membrane.

4. Two-compartment container of claim 1, wherein the closure means comprise an interference fit and also the inner side wall fits tightly to the opposite base part or top part via an interference fit which, however, has a smaller overlapping range.

5. Two-compartment container of claim 1, wherein both the base and top parts are made from plastics.

6. The two-compartment container of claim 5, wherein the plastics comprise polyalkylenes.

7. The two-compartment container of claim 5, wherein the plastics comprise polypropylene.

8. Two-compartment container of claim 1, wherein the top part has the inner side wall and the base part has the outer side wall.

9. Two-compartment container of claim 1, wherein the top part has the outer side wall and the base part has the inner side wall.

10. Beverage container having a releasable seal in an upper wall region, containing an inner two-compartment container of claim 1 for receiving a constituent for the mixture thereof with a main beverage liquid in two-compartment container, wherein the parts of said two-compartment container are connected to each other and one of the compartments thereof is filled with the constituent, while the other or second compartment thereof mainly or merely contains gas.

11. Beverage container according to claim 10, wherein the two-compartment container is fixed to the bottom of the beverage container.

12. Beverage container according to claim 10 wherein the two-compartment container is freely floating or movable within the beverage container.

13. Beverage container of claim 10, wherein the base part and the top part of the two-compartment container are sized such that they cannot escape from the beverage container through an opening that is created in the upper wall region by breaking the releasable seal in order to deliver the beverage therefrom.

14. Beverage container of claim 10 which is a beverage can.

15. The beverage container according to claim 11, wherein the two-compartment container is fixed to the bottom of the beverage container by a glue.

16. The beverage container according to claim 11, wherein the two-compartment container is fixed to the bottom of the beverage container by a mechanical fit.

17. Method for mixing a constituent into a main beverage liquid in a beverage container just before the beverage is consumed, comprising the following steps:

(a) filling the first compartment of a two-compartment container of claim 1 with a constituent, (b) optionally flushing the second compartment of the two-compartment container with a gas, (c) sealing both parts of the two-compartment container via a closure means, (d) putting the two-compartment container into a primary chamber of the beverage container and optionally affixing said two-compartment container onto the bottom of said beverage container, after or prior to the (e) filling of the primary chamber of the beverage container with the main beverage liquid, (f) seaming the beverage container while pressurizing a head space above the main beverage liquid in the primary chamber of the beverage container in order to obtain a pressure above environmental pressure inside the beverage container, (g) providing a slow pressure equilibration between the inside of the second compartment of the two-compartment container and the primary chamber of the beverage container, (h) opening the beverage container by releasing a releasable seal, thereby inducing a sudden pressure decrease to ambient pressure in the beverage container, (i) breaking the closure means via a sudden pressure difference inside and outside the second compartment in the two-compartment container, thereby separating the top part and the base part of the two-compartment container and releasing the constituent into the main beverage liquid.

18. The method of claim 17, wherein the gas is nitrogen.

* * * * *

UNITED STATES PATENT AND TRADEMARK OFFICE

CERTIFICATE OF CORRECTION

PATENT NO. : 6,620,444 B1
DATED : September 16, 2004
INVENTOR(S) : Richard Reichinger It is certified that error appears in the above-identified patent and that said Letters Patent is hereby corrected as shown below:

Column 1,
Line 57, after "or" insert -- near the lowest point(s) in the capsule. The capsule comprises closure means, e.g. a --

Column 2,
Line 2, delete "b ore" and replace it with -- bore --

Column 9,
Lines 41-42, delete "in two-compartment container" and replace it with -- in the said beverage container --.

Signed and Sealed this

Seventeenth Day of August, 2004

JON W. DUDAS
*Acting Director of the United States Patent and Trademark Office*